US005803286A

United States Patent [19]

Pfefferkorn et al.

[11] Patent Number: 5,803,286

[45] Date of Patent: Sep. 8, 1998

[54] PLASTIC CLOSURE CAP WITH EARLY VENTING INNER SEAL

[75] Inventors: George Pfefferkorn; Michael Kirchgessner, both of Egringen, Germany

[73] Assignee: Crown Cork AG, Rainach, Switzerland

[21] Appl. No.: 725,057

[22] Filed: Oct. 2, 1996

Related U.S. Application Data

[63] Continuation of Ser. No. 363,383, Dec. 23, 1994, abandoned.

[30] Foreign Application Priority Data

Dec. 23, 1993 [CH] Switzerland ..... 3873/93

[51] Int. Cl.[6] ..... B65D 51/16

[52] U.S. Cl. ..... 215/307; 215/344; 215/DIG. 1; 215/354

[58] Field of Search ..... 215/307, 341, 215/343, 344, 354, DIG. 1; 220/303, 307, 360, 366.1, 367.1, 796, 231

[56] References Cited

U.S. PATENT DOCUMENTS 4,192,428 3/1980 Segmuller ..... 215/307 X 4,560,077 12/1985 Duff ..... 215/307

FOREIGN PATENT DOCUMENTS 0118267 10/1986 European Pat. Off. .

*Primary Examiner*—Allan N. Shoap
*Assistant Examiner*—Robin A. Hylton
*Attorney, Agent, or Firm*—Woodcock Washburn Kurtz Mackiewicz & Norris LLP

[57] ABSTRACT

The invention concerns a plastic screwable closure cap which possesses a bung type internal seal (4) for sealing a closeable container. The internal seal comprises a narrow sealing portion with an insert portion (6) immediately beneath, said insert portion serving to centre and gently introduce the internal seal. In order to attain the earliest possible venting of the closure cap when screwing off, venting recesses are provided on the insert zone (6). These prevent the insert portion from sealing the container, and enable the release of gas from the container as soon as the sealing portion comes out of engagement with the container mouth. The side surfaces of the vent recesses also serves as friction surfaces, in order to generally flatten irregularities on the container mouth before the actual sealing portion is engaged.

11 Claims, 4 Drawing Sheets

PLASTIC CLOSURE CAP WITH EARLY VENTING INNER SEAL

This is a continuation of application Ser. No. 08/363,383, filed Dec. 23, 1993, now abandoned.

BACKGROUND OF THE INVENTION

The invention concerns a screwable closure cap of a plastic material according to the preamble to claim 1. The term "screwable" is in this respect to be understood in such a way that not only closure caps with screw threads but also bayonnet closures are implied. These types of closure caps have been known and in use for a long time, are mainly used for closing bottles for refreshment beverages containing carbon dioxide. In the cases of bottles, these are frequently re-useable bottles made of glass or PET. Since the container mouth, in particular in the case of re-useable bottles, is frequently damaged, seals which protrude into the container mouth are frequently used for sealing of the container. In this way, the main sealing portion is displaced slightly into the interior of the bottle mouth. An optimal sealing effect is ensured in this way, also when the area of the mouth is damaged. EP-118 267 shows such a closure cap.

In the case of refreshment beverages containing carbon dioxide, high internal pressure exists within the closed container. A problem with these types of closure caps is that internal pressure can only be reduced when the internal seal is fully removed from the container mouth. Internal seals of the said type possess a surrounding sealing portion, whose outer diameter is somewhat larger than the inner diameter of the bottle mouth. It is thus ensured that the sealing portion, when the closure cap is attached, is pressed against the inner wall of the bottle mouth. An insert portion is located beneath the sealing portion, the outer diameter of which is slightly conically reduced in the downward direction, so that the diameter of the lower end of the seal is smaller than the diameter of the bottle mouth. This is necessary in order to ensure damage-free insertion of the internal seal when screwing on the screw cap. This configuration for the internal seal enables the upper area of the insert portion to still tightly seal the container if the actual sealing portion has already assumed a position outside the container mouth. This in turn leads to an unnecessarily late reduction of pressure when the closure cap is being screwed off. Although, in principle, this disadvantage could be dealt with by shortening the insert portion, a certain length for the insert portion is necessary, in order to introduce the inner seal both reliably and protectively.

The known seals have a further disadvantage, in that the outside surface of the insert portion, which makes the initial contact with the container mouth, possesses a smooth outer surface. As a result, the insert portion is hardly capable of levelling the rough, irregular or damaged points on the bottle mouth, with the additional risk that the sealing portion, which is essentially responsible for sealing, can be subjected to damage.

SUMMARY OF THE INVENTION

It is therefore a purpose of the invention to avoid the known disadvantages, and in particular to create a closure cap of the type mentioned in the introduction, with which the internal pressure is reliably reduced while screwing off the closure cap, as soon as the sealing portion of the internal seal has taken up a position outside the container mouth. At the same time, insertion of the internal seal into the container mouth should in no way be detrimentally affected. A further purpose of the invention is to design the insert portion in such a way that surface irregularities of the container mouth are flattened when screwing on the closure cap, so that the sealing portion is not, at the same time, subjected to damage.

According to the invention, the purpose of the invention is fulfilled by a closure cap possessing the features of claim 1. The internal seal possesses a sealing portion, and an insert portion beneath said sealing portion. The sealing portion is that part of the internal seal which makes contact with the inner side of container mouth when the closure cap is attached, thus forming a seal. The primary purpose of the insert portion is to reliably and gently introduce the internal seal into the container mouth. From the functional point of view, the insert portion can be further subdivided: the most forwardly placed section is the centering zone, in which the outer diameter is less than the diameter of the container mouth. This zone centers and guides the internal seal during attachment of the closure cap. Following the centering zone is a compression zone, in which the outer diameter is larger than the diameter of the container mouth. During introduction of the compression zone into the container orifice, the internal seal is compressed, and thus placed under tension. In the area of the insert portion, the outer surface of the internal seal possesses at least one vent recess. This vent recess forms a connecting channel to the interior space of the container as soon as the sealing portion becomes disengaged from the container mouth. It prevents the insert portion from being able to form a seal with the container mouth, and thus ensures that venting of the container occurs at the earliest possible moment. It is thus ensured that the internal thread of the closure cap remains securely engaged with the outside thread of the container neck until commencement of venting. In the case of excessive internal pressure and delayed venting of the container, the risk of sudden ejection of the closure cap while screwing off said closure is this avoided.

The vent recess is preferably designed in such a way that it extends at least over the entire height of the compression zone. It will thus be ensured that an open vent channel exists as soon as the sealing portion is out of engagement with the container mouth.

The number of vent recesses, as well as their width and depth, impart an influence on the rate of venting when opening the container. It must be noted that the insert zone does not fulfill its function in the area of the vent recess. In order to prevent destruction of the sealing portion in the area of the vent recess, it is beneficial to ensure that the width of the vent recess does not exceed 1/15 of the circumference of the inner seal.

Independent from the vent recesses, the diameter of the insert portion is to be understood as the diameter of the outermost surface. If a plurality of vent recesses are directly adjacent to each other, then the outer surface of the insert zone can be reduced to a series of individual edges. Thus, the term "uninterrupted surface" will occasionally be used, by which a theoretical outer surface without vent recesses is implied. The internal seal is frequently so designed that its outer diameter in the area of the insert portion reduces towards its lower end. The outer diameter, as a rule tapering and reducing continuously in the downward direction, results in uniform compression of the internal seal whilst being screwed on, until the sealing portion has entered the container mouth. During this compression phase, the insert portion makes contact with the inner edge of the container mouth. The friction occurring through rotation of the closure has in this case a flattening effect on any irregularities in the area of the mouth. Such a frictional effect can be aimed at by suitable design of the vent recesses.

In the case of another, likewise beneficial, design of the insert portion, said insert portion merely possesses a slipping zone in its lower area, within which the outer diameter reduces towards the lower end. Between the slipping zone and the sealing portion, the outer diameter of the internal seal possesses a local minimum value in the form of a groove, so that at the upper end of the said slipping zone a local maximum value will ensue, said maximum value being greater than the diameter of the container mouth to be closed. This is beneficially selected to be as large as possible, indeed in such a way that, with the closure cap placed on the container mouth, the cutting edge will be lifted from the inner wall of the container as soon as the sealing portion is introduced into the container mouth. This configuration has the advantage that the insert portion, when screwing on the closure cap, will make contact with the inner surface of the mouth as soon as the slipping portion has entered the container mouth. Thus, the frictional effect of the insert portion will also be effective in the area of the mouth inner surface.

The shape of the vent itself can also strongly influence the frictional effect of the insert portion. The frictional effect will be beneficially enhanced if, between the vent recesses, cutting edges are provided, for flattening irregularities or damaged edges on the mouths of plastic containers. In describing the design of these recesses, standard terms from milling and cutting processes will be used to define the cutting geometry. With that, the vent recesses should be compared with the gap between two saw teeth. Although the closure cap comprises relatively soft plastic, the best results are attained with an effective cutting angle of approximately 0°. The surface of the vent recess, on its forward end seen in the direction of screwing on, forms the face which meets the uninterrupted surface of the insert portion approximately at right angles along a cutting edge. The cutting edge is thus so aligned that it can operate as a blade during rotation of the closure cap in the direction of screwing on. Optimal results can be obtained with an effective cutting angle in the region of ±10°. No actual material removing process can be attained with the aid of this primitive plastic cutter, even with plastic containers. That is also not intended, since plastic chippings would otherwise fall into the beverage. In practice, a type of plastic deformation of burrs and notches is concerned, which would actually suggest a negative effective cutting angle. Due to the soft cutting material, the best results were nevertheless obtained with effective cutting angles of approximately 0°.

Since the insert portion comes into engagement while screwing on the closure cap for only a fraction of a rotation, a single vent recess is not sufficient for processing the entire circumference of the mouth in the way described above. The closure cap can be further improved, therefore, by uniformly arranging a plurality of vent recesses around the diameter of the internal seal. Particularly satisfactory frictional properties are attained if the vent recesses are arranged at the same distance from each other, in particular if a plurality of vent recesses are arranged directly adjacent to each other, so that the outer surface of the internal seal will be restricted to that area where the vent openings make contact on single edges. When screwing on the closure cap, the contact surface in the insert zone is thus restricted to individual edges, and this results in high surface pressure, which in turn has a positive effect on the friction and levelling effect.

In the case of directly adjacent vent recesses, the best results are obtained using the already mentioned cutting geometry with an effective cutting angle of 0°. In order to nevertheless ensure stability of the individual "saw teeth", the surface of the vent recess is, on its opposite side, on the rear end as seen in the direction of screwing on, designed in such a way that, at a shallow angle, it meets the "uninterrupted surface", as already defined, of the internal seal as a heel. Good results were obtained with a heel angle of less than 30°.

As an alternative to the saw tooth shaped design, symmetrical vent recesses can also be used. A cutting geometry with a negative effective cutting angle and a positive heel angle will thus arise, which both possess the same value. Similar frictional values are thus attained for screwing on and off. Good results are achieved if the effective cutting angles and heel angles are each less than 60°.

A high frictional value, without limiting the centering and guide functions of the insert portion, were achieved with internal seals which possess at least 25 and at most 50 vent recesses, distributed around the circumference.

BRIEF DESCRIPTION OF THE DRAWINGS

The invention will be more closely described in the following, with the aid of examples of different embodiments, namely.

DETAILED DESCRIPTION OF THE PREFERRED EMBODIMENTS

Figure 1:
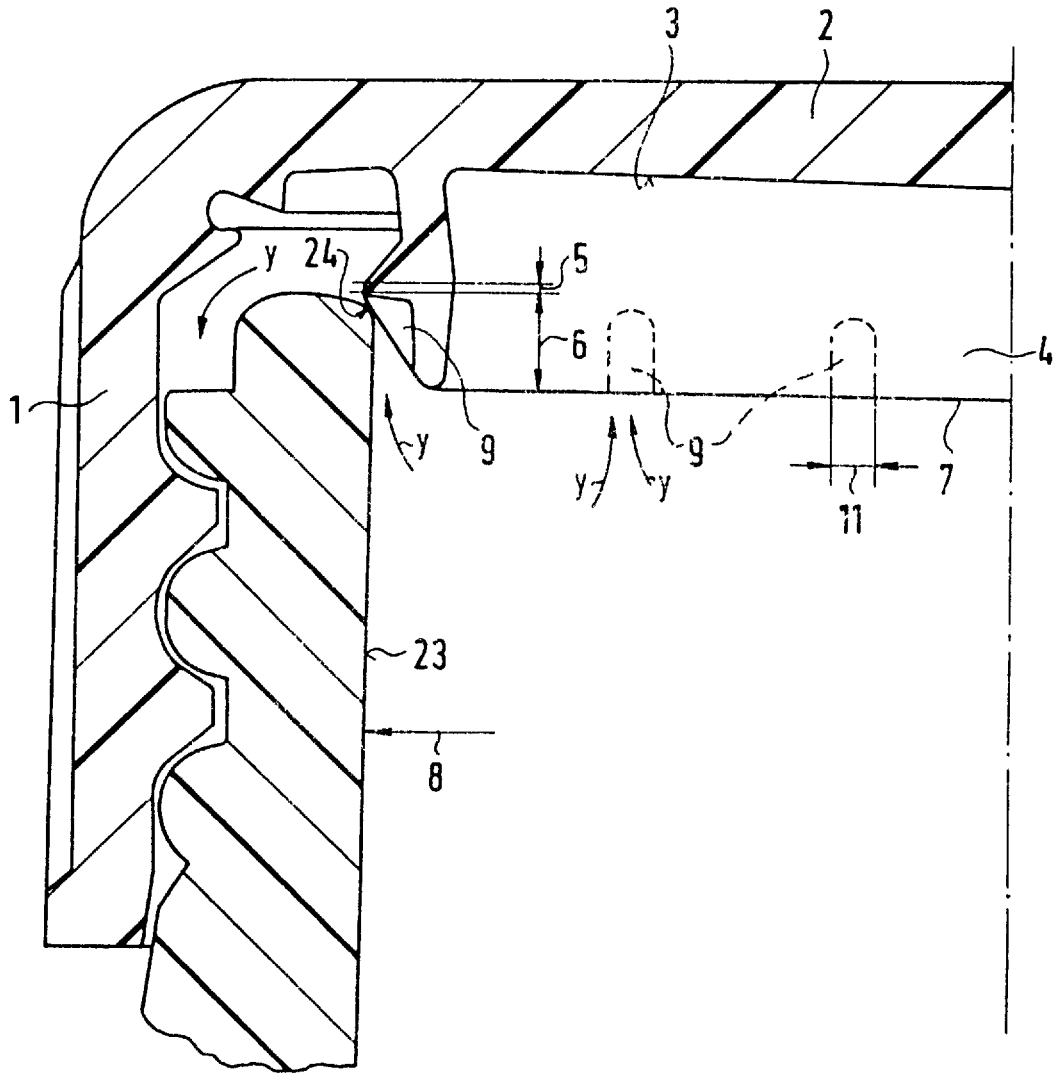
FIG. 1 A cross section of a container mouth with a closure cap which is screwed off until venting is initiated, FIG. 2 a cross section of a container mouth with a closure cap with, in places, interrupted insert portion, FIG. 3 a cross section of the sealing area of a closure cap, FIG. 4 a cross section of a sealing portion of a closure cap in the screwed on position, FIG. 5 a cross section through the plane A—A according to FIG. 6, FIG. 6 a detail of the side view of an internal seal with a plurality of adjacent vent recesses arranged like saw teeth, FIG. 7 a detail of the internal seal shown in FIG. 6 (direction B according to FIG. 6)

FIG. 1 shows a cross section of a container mouth with a closure cap which has been screwed off until venting is initiated. The closure cap comprises a cylindrical cap wall 1 and an adjacent cap base 2. An internal seal 4 extends, coaxially with the cap wall 1, from the internal surface 3 towards the cap opening. If the closure cap is completely screwed onto the container neck, then a limited area of the outer surface of the internal seal will make contact with the inner surface 23 of the container mouth. This area is classified as the sealing portion 5. Its outer diameter is greater than the diameter 8 of the container mouth. The insert portion 6 is beneath the sealing portion. The outside diameter of said insert portion reduces conically downwards. When screwing on the closure cap, the outside surface of the insert portion 6 is the first to come into contact with the container mouth, with the sealing portion 5 only reaching the container mouth later. The diameter of the insert portion, which reduces downwards, rests against the inner edge 24 of the container mouth. It centres the internal seal on the container mouth and ensures that this is gently tensioned before the seal portion 5 reaches the container mouth. When screwing off the closure cap, the reverse procedure will apply. First of all, the sealing portion is retracted from the container mouth, although the internal seal initially remains under tension because the insert portion is still in contact the container mouth. The internal seal can only once again expand if, with further unscrewing, the insert portion is extracted from the container mouth. During unscrewing, the insert portion remains in contact with the container mouth until the internal seal has expanded into its normal position. The insert portion is consequently divided into two areas: the lower area of the insert portion serves to centre the internal seal on the container mouth, and the compression zone commences at the point where the outside diameter of the insert portion reaches the diameter 8 of the container mouth.

In the area of the insert portion, the internal seal possesses a plurality of vent recesses. These prevent the internal seal, during screwing off of the closure cap, from forming a sealing action in the area of the compression zone. In order to ensure venting of the container at the earliest possible moment, the vent recesses 9 commence directly beneath the sealing portion. With the closure cap shown here, the sealing portion is located just outside of the container mouth. Gas from the container can flow through the vent recesses 9, in the direction of the arrow Y.

In order to place the internal seal under uniform tension by means of the insert portion, care must be taken that the width 11 of the vent recesses is not selected to be too large. If the slipping surface of the insert zone is interrupted by very wide vent recesses, there will be a risk that the internal seal, in the area of these recesses, will locally be pressed outwards during screwing on. This can lead to damage to the seal portion during attachment of the closure cap. Good results have been achieved with vent recesses, the width of which are not in excess of 1/15 of the seal circumference.

Figure 2:
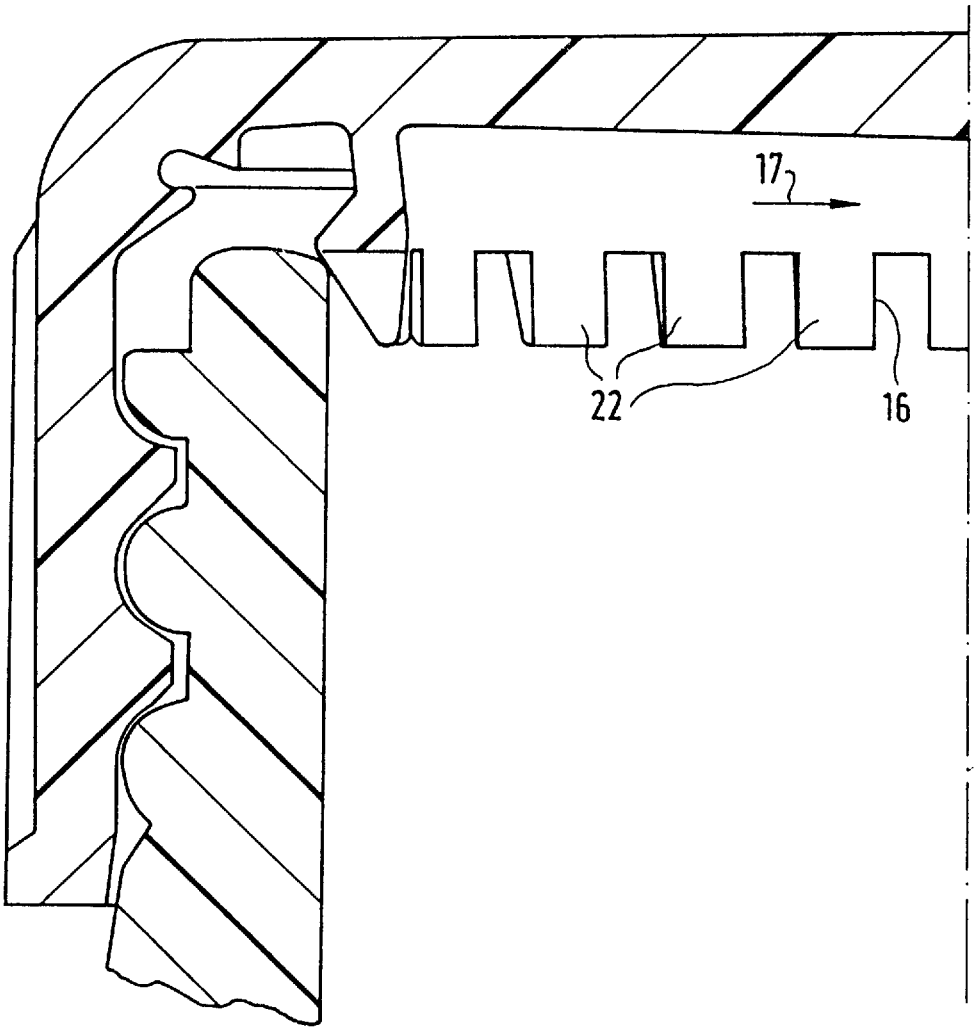

FIG. 2 shows a cross section of a container mouth with a closure cap with an insert portion which is, in places, interrupted. The vent recesses used in this case are slots which divide the insert zone into individual guide lugs 22. These continuous slots cause very rapid venting of the container as soon as the sealing portion is disengaged from the container mouth. The closure cap has a right-hand thread, so that the portion 16 located on the front edge of the recess surface, seen in the direction 17 of screwing on, acts as a face and forms a cutting edge with the outside surface of the internal seal. Although, because of the heel angle of 0°, the expression "cutting" cannot be used in an actual sense with the insert lugs 22, the terminology face and cutting edge will nevertheless be applied here.

Figure 3:
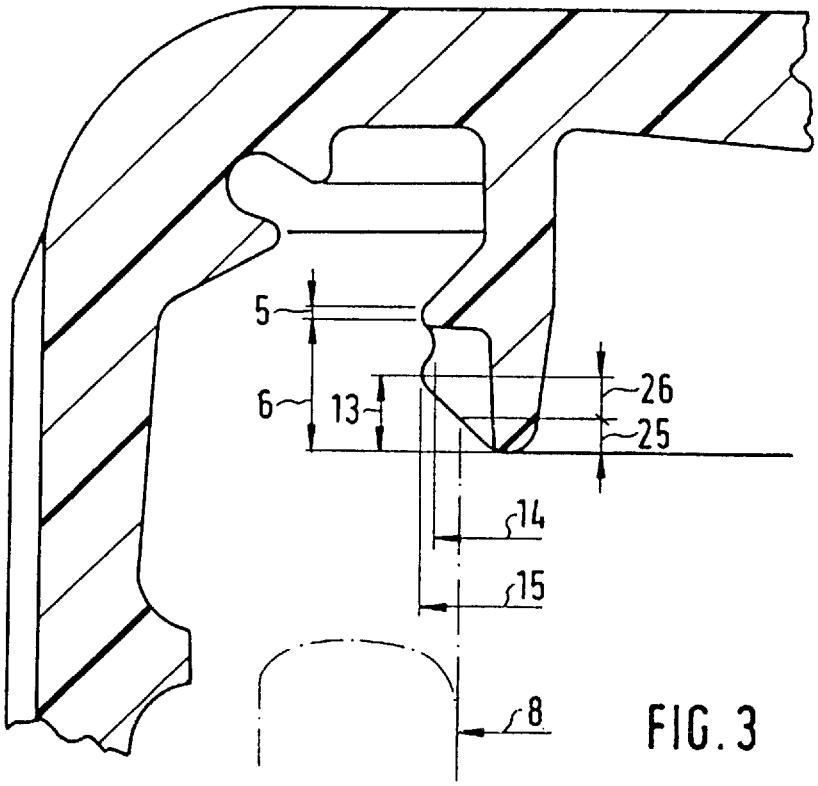

FIG. 3 shows the sealing area of a closure cap according to the invention. The internal seal possesses a local maximum 15 in the area of the insert portion 6. The centering and compressing function of the insert portion is assumed by slipping zone 13 located beneath the said maximum diameter. The slipping zone itself is functionally divided into a centering zone 25 in which the outer diameter is less than the diameter 8 of the container mouth, and a compression zone 26 in which the outer diameter is greater than the diameter 8 of the container mouth. The container mouth to be closed has been suggested by a dotted line. Between the local maximium 15 and the sealing portion 5, the internal seal possesses a groove shaped depression so that the outer diameter here reduces to a local minimum 14. Thus, the levelling frictional effect of the insert zone is beneficially further extended into the inner surface of the container mouth. The friction takes effect on the inner edge of the container mouth, until the slipping zone 13 has been fully inserted into the container mouth. During further rotation to close the closure cap, that point with the local maximum diameter is forced into the container mouth and the frictional effect is then displaced onto the inner surface of the container mouth. By this means, also surface irregularities on the inner side of the mouth will be levelled by the insert portion. The compression of the internal seal is not increased in this case. The compression of the internal seal is only slightly raised again if, after further screwing on, the sealing portion 5 extends further into the container mouth, whereupon the main force of the tensioned internal seal is imparted onto the sealing portion. The maximum diameter of the insert portion is beneficially selected in such a way that said insert portion is completely relieved as soon as the sealing portion has been introduced into the container mouth.

Figure 4:
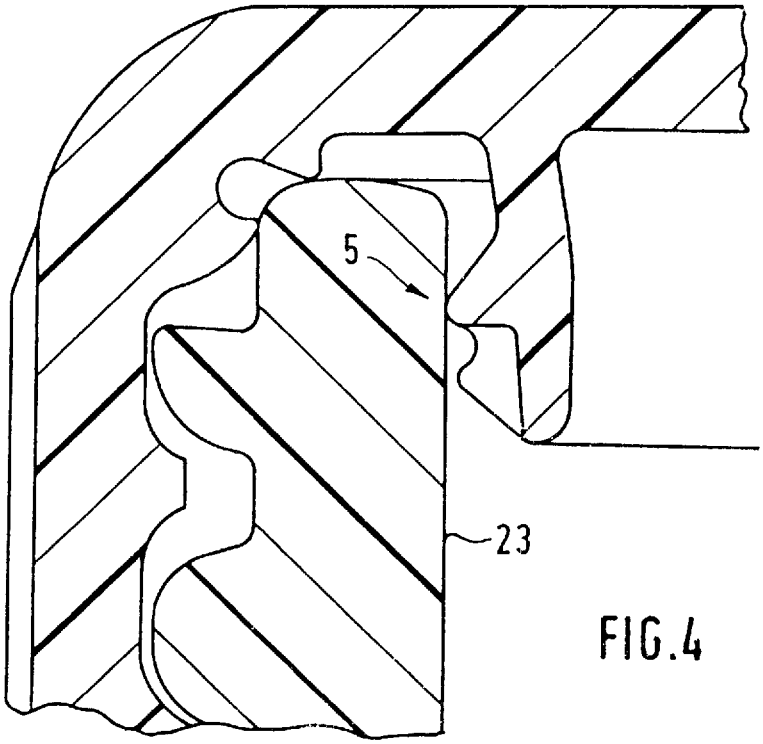

FIG. 4 shows a cross section of the sealing area of a closure cap in the screwed on position. The closure is in the fully screwed on position and the internal seal is in contact with the inner surface of the mouth 23 of the container, solely in the area of the sealing portion 5.

Figure 5:
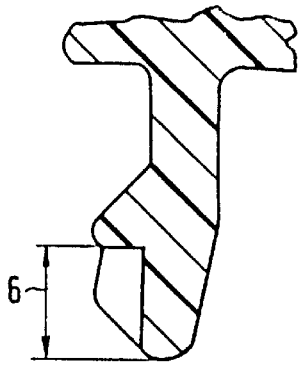
Figure 6:
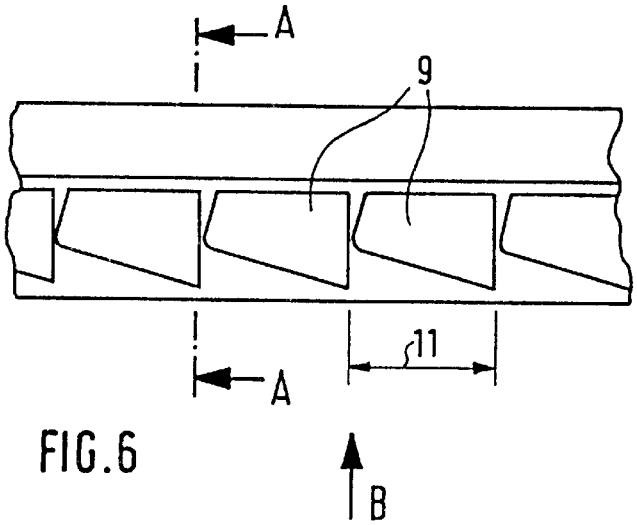

FIG. 5 shows a cross section through the plane A—A according to FIG. 6. An internal seal is concerned here, the outer diameter of which possesses a local maximum in the area of the insert portion 6.

FIG. 6 shows a detail of the side view of an internal seal, the outer diameter of which, as can be seen in FIG. 5, possesses a local maximum in the area of the insert portion. This cross-sectional configuration of the internal seal has already been explained in connection with FIGS. 3 and 4.

The internal seal possesses, in the insert portion, a plurality of directly adjacent vent recesses 9 around the entire circumference. In this example, two adjacent vent recesses 9 make contact solely at one point, namely there, where the outer diameter of the insert portion is at its greatest. This point is at the same time the most essential for the frictional effect since, as explained in connection with FIG. 3, a frictional effect is also imparted onto the inner side of the mouth by this point. By means of the recesses being immediately adjacent to each other, the insert portion attains a form which possesses the character of a cutting tool.

Figure 7:
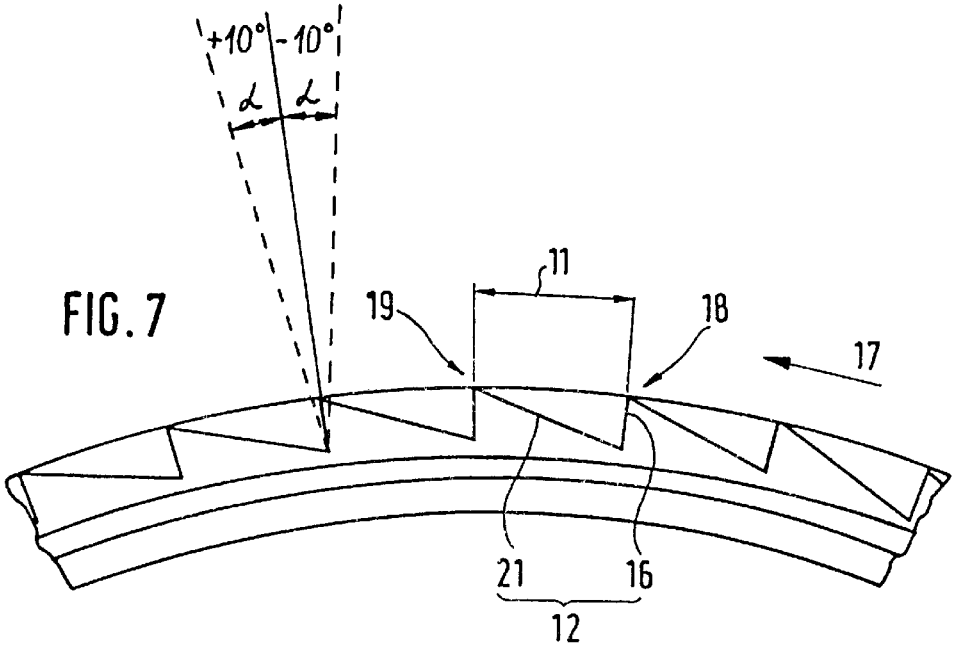

FIG. 7 shows the internal seal as shown in FIG. 6 from below (direction B according to FIG. 6). The cutter shaped indentation through the vent recesses can be seen in this representation. On the front side of the vent recesses, seen in the direction of rotation during screwing on, the face 16 forms an angle of approximately 90° with the uninterrupted surface of the internal seal, which is the equivalent of an effective cutting angle of 0°. A preferred region of ±10°, for selection of the effective cutting angle $\alpha$, is shown by a dotted line in this figure. On the rear end of the recess, the heel 21 creates a somewhat shallow angle with the same uninterrupted surface. In this example, not only the heel 21 but also the face 16 is formed as a plane running parallel to the axis of the closure cap. As a result of the cross section selected for the seal, which can be seen in FIG. 5, the individual recesses meet solely at one point. Further embodiments of the vent recesses are possible, for optimization of the desired frictional effect. These will be dependent on the assessment of the expert. In particular, the recesses can also be formed in such a way they make contact with each other not merely at one point, but along a cutting edge.

Inasmuch as the invention is subject to modifications and variations, the foregoing description and accompanying drawings should not be regarded as limiting the invention, which is defined by the following claims and various combinations thereof:

We claim:

1. A screwably plastic closure cap for sealing a container at its orifice, said closure cap comprising:

a cylindrical cap wall;

a cap base having an inner surface and being adjacent to said cylindrical cap wall;

an internal seal extending downwardly from the inner surface of said cap base, said internal seal possessing a radially outer surface comprising a surrounding sealing portion on its outer edge for internal sealing of the container orifice to be closed and possessing an insert portion beneath the sealing portion;

said sealing portion being spaced from the cap base and defining a maximum outer diameter of the internal seal prior to placement on the container;

said insert portion comprising a compression zone, whereby the compression zone is designed to engage the container orifice and be compressed when the insert portion is inserted into the orifice;

wherein the radially outer surface of the internal seal possesses, in the area of said insert portion, at least one vent recess, said vent recess extending at least over the entire height of the compression zone, said compression zone and said at least one vent recess being axially below said sealing portion.

2. A closure cap according to claim 1, characterized in that the outer diameter of the internal seal, in the area of the insert portion (6), reduces towards the lower end (7) of said internal seal.

3. A closure cap according to claim 1, characterized in that the width (11) of the vent recess does not exceed 1/15 of the circumference of the internal seal.

4. A closure cap according to claim 1, characterized in that, on the front end (18) of the vent recess seen in the direction of screwing on (17), the surface of said vent recess meets the uninterrupted surface formed on the insert portion as a face (16), along an effective cutting edge (18) and approximately at a right angle.

5. A closure cap according to claim 1, characterized in that a plurality of vent recesses (9) are arranged to be distributed around the circumference of the internal seal.

6. A closure cap according to claim 5, characterized in that, between the vent recesses, cutting edges are provided to flatten irregular or damaged edges of the mouth of plastic containers.

7. A closure cap according to claim 6, characterized in that the vent recesses are arranged at a uniform distance from one other.

8. A closure cap according to claim 7, characterized in that the vent recesses (9) are immediately adjacent to one another.

9. A closure cap according to claim 8, characterized in that, at the rear end (19) of the vent recess (9) seen in the direction of screwing on (17), the surface of the vent recess meets an uninterrupted surface of the insert portion at a shallow angle as a heel (21).

10. A closure cap according to claim 1, characterized in that the internal seal possesses at least 25, and at the most 50, vent recesses (9).

11. A closure cap according to claim 1, characterized in that the insert portion possesses a slipping zone in its lower most region, the diameter within that slipping zone reducing towards the lower end, and the outer diameter between the slipping zone and the sealing portion possessing a local minimum value so that the local maximum diameter will arise at the upper end of said slipping zone, said maximum diameter being designed to engage the container at the orifice when said closure cap is applied to the container.

* * * * *

UNITED STATES PATENT AND TRADEMARK OFFICE

CERTIFICATE OF CORRECTION

PATENT NO. : 5,803,286

DATED : September 8, 1998

INVENTOR(S) : George Pfefferkorn; Michael Kirchgessner

It is certified that error appears in the above-indentified patent and that said Letters Patent is hereby corrected as shown below:

Page 1, Column 1, Line 8, delete "Rainach" and insert - - Reinach- - therefor.

Page 1, Column 2, Line 4, insert " 4,712,699 12/87 Lutz 215/354 X

Column 1, Line 5, delete "Dec. 23, 1993," and insert - -Dec. 23, 1994- - therefor.

Column 1, Line 16, delete "In the cases of bottles," and insert - -In the case of bottles,- - therefor.

Column 2, Line 35, delete "is this avoided." and insert - -is thus avoided.- - therefor.

Column 4, Line 65, delete "is still in contact the" and insert - -is still in contact with the- - therefor.

Column 6, Line 63, delete "A screwably plastic" and insert - - A screwable plastic- - therefor.

Signed and Sealed this

Eighth Day of June, 1999

*Attest:*

Q. TODD DICKINSON

*Attesting Officer*

*Acting Commissioner of Patents and Trademarks*